US006368256B1

(12) United States Patent
Rumbaugh

(10) Patent No.: US 6,368,256 B1
(45) Date of Patent: Apr. 9, 2002

(54) METHOD AND DEVICE FOR ASSISTING THE LEG MUSCLES DURING CYCLING

(76) Inventor: Garry Rumbaugh, 683 Brandy La., Westminster, MD (US) 21157

( * ) Notice: Subject to any disclaimer, the term of this patent is extended or adjusted under 35 U.S.C. 154(b) by 0 days.

(21) Appl. No.: 09/711,952

(22) Filed: Nov. 15, 2000

Related U.S. Application Data

(62) Division of application No. 09/246,710, filed on Feb. 9, 1999, now Pat. No. 6,179,760.

(51) Int. Cl.[7] ..... A63B 21/02
(52) U.S. Cl. ..... 482/121; 482/122; 482/124
(58) Field of Search ..... 482/121, 122, 482/124, 125–21, 139; 2/69

(56) References Cited

U.S. PATENT DOCUMENTS 4,458,363 A * 7/1984 Harvey ..... 2/2.11
5,768,702 A * 6/1998 Kim ..... 2/1

* cited by examiner

*Primary Examiner*—Michael A. Brown
*Assistant Examiner*—Lalita Hamilton
(74) *Attorney, Agent, or Firm*—William E. Mouzavires

(57) ABSTRACT

Method and device for operating a bicycle having a sprocket and pedals connected to the sprocket for rotating the sprocket during downstrokes and upstrokes of the pedals. The method and device include elastic members worn on the legs such that the elastic members will stretch on the downstroke of the pedals to generate energy and contract on the upstroke to release the energy for assisting the legs to rotate the pedals and in turn the sprocket. For a given cycle and cyclist, greater speeds of the cycle may be obtained by the cyclist. The elastic members are constructed and dimensioned such that about 3 to 12 pounds of tension is created in them during the downstroke of the pedals. Similar members may be worn on the feet to generate energy and transfer it to the feet again to enhance speed of operation of the bicycle.

13 Claims, 5 Drawing Sheets

METHOD AND DEVICE FOR ASSISTING THE LEG MUSCLES DURING CYCLING

RELATED APPLICATION

This application is a divisional of my prior U.S. application Ser. No. 09/246,710 filed Feb. 9, 1999, now U.S. Pat. No. 6,179,760 entitled METHOD AND DEVICE FOR ASSISTING THE LEG MUSCLES DURING CYCLING.

BACKGROUND AND OBJECTS OF THE PRESENT INVENTION

The present invention generally relates to methods and apparatus for operating a cycle such as a bicycle.

In recent years including the present, bicycling and other cycling whether for entertainment, sport or exercise has greatly increased in popularity. This has spawned many inventions and developments in this field primarily aimed at increasing performance of the cycle. These innovations for the most part have concentrated on the cycle itself for example by improving the operation of the various parts and also decreasing the overall weight of the cycle by using lightweight materials. In contrast to the latter areas of invention and development, the present invention takes an entirely novel approach by focusing on the performance of the cyclist rather than the cycle itself.

Accordingly one of the objects of the present invention is to provide a novel and improved method and device for increasing the performance of a cyclist during bicycling or other cycling. Included herein is the provision of such method and device for increasing the speed performance obtainable by the cyclist for a given cycle or bicycle.

Another object of the present invention is to provide a novel method and device for generating energy for transfer to the legs of a cyclist to increase performance of the cyclist in rotating the pedals and sprocket of the cycle. Included herein is the provision of such method and device which maybe used to increase the speed of operation of a cycle for a given cyclist and a given cycle.

A further object of the present invention is to provide novel method and apparatus as described above that may be applied to virtually any cyclist for increasing the cyclist's performance and speed on a cycle. Included herein is the provision of such method and apparatus that can be utilized to decrease the imbalance that may exist between the hamstring and quadriceps muscles of a cyclist thereby increasing the performance of the cyclist.

A still further object of the present invention is to provide a novel device or apparatus that may be worn by the cyclist to increase the cyclist's performance of a bicycle or other cycle. Including herein is such a device that generates energy from the movement of the cyclist's legs and releases the energy into the cyclist's legs for increasing performance of the cyclist.

SUMMARY OF INVENTION

The present invention includes method and device for operating a cycle of the type having a sprocket and pedals connected to the sprocket for rotating the sprocket on downstrokes and upstrokes of the pedals. The invention includes a provision of one or more elastic members applied to the legs of the cyclist such that the elastic members will stretch on the downstroke of the pedals to generate energy and contract on the upstroke of the pedals to release the energy for assisting the cyclist's legs to rotate the pedals and in turn the sprocket. In the preferred embodiment, energy members are also worn on the foot-ankle area of the cyclist such that they will stretch when the foot points generally downwardly to generate energy and contract when the foot returns to a horizontal or upward position to transfer the energy into the feet for assisting the rotation of the pedals together with the energy members worn on the cyclist's legs.

DRAWINGS

Other objects and advantages of the present invention will become apparent from the following detailed description taken in conjunction with the accompanying drawings in which.

DETAILED DESCRIPTION

Figure 3:
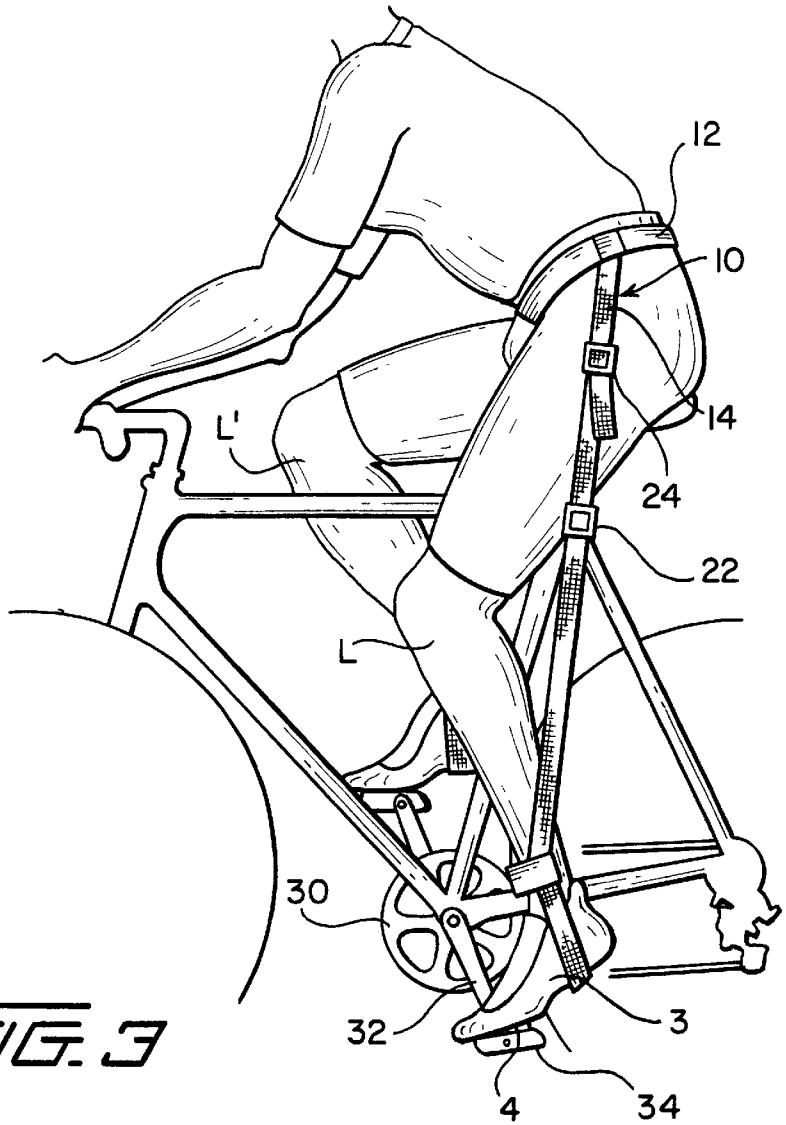
FIG. 3 is a side elevational view of a cyclist wearing the device of the present invention while riding a bicycle.
Figure 6:
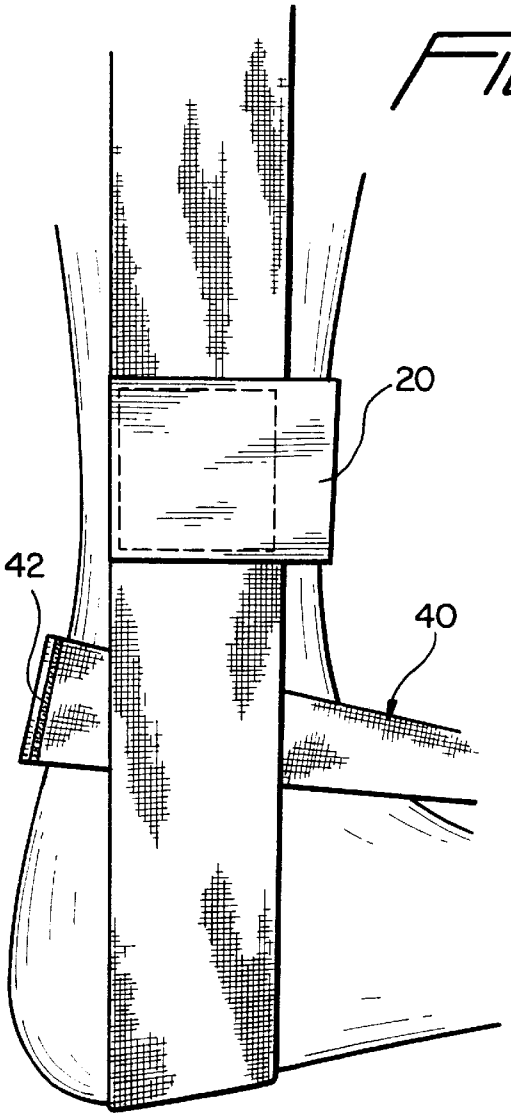
FIG. 6 is a fragmental side view of a foot-ankle area of the cyclist showing a lower portion of the device of the present invention as well as the foot-ankle member worn on the foot-ankle area of the cyclist.

Referring now to the drawings in detail there is shown for illustrative purposes only methods and apparatus constituting preferred embodiments of the present invention for assisting the leg muscles during cycling. FIG. 3 shows a cyclist on a bicycle including a sprocket 30 having arms 32 connected to pedals 34. In accordance with the method of the present invention, the cyclist wears on his leg, preferably both legs, a member referred to herein as an "energy member" which will be stretched or extended during pedaling on the downstroke when one leg is extended such as L shown in FIG. 3 while the other leg L' is raised to raise the pedal during the upstroke of that pedal. When the energy member is extended it generates energy for assisting the leg muscles and particularly the hamstring muscles upon raising the leg during the upstroke when the leg raises the pedal preferably through a connection between the foot and the pedal such as maybe obtained through conventional cyclist's shoes 3 which have a cleat or lug 4 projecting from the bottom of the cyclist's shoe for receipt in a receptacle fixed to the pedal 34 as best shown in FIG. 3. During the upstroke of the pedal, the energy previously generated on the downstroke in the energy member is released and transmitted to the leg to assist the upstroke. This will result in increased performance of the cyclist and in turn increased speed of the cycle. It is preferred that two energy members one for each leg be used. The energy members may be attached to the legs above and below the knees in any suitable manner so that they will be stretched on the downstroke to generate energy and contracted on the upstroke to release and transfer the energy to the legs. The energy members may take any suitable form or construction such as an elongated elastic strap or member or even an elongated coil spring. In addition the energy members may be incorporated in the legs of a pair of cyclist's tights or pants which have bottom straps which go around the bottoms of the feet while the tights on pants are secured to the body at the waist so that upon the downstroke the pants leg will be stretched to store energy and upon the upstroke will contract to release the energy into the legs.

Figure 1:
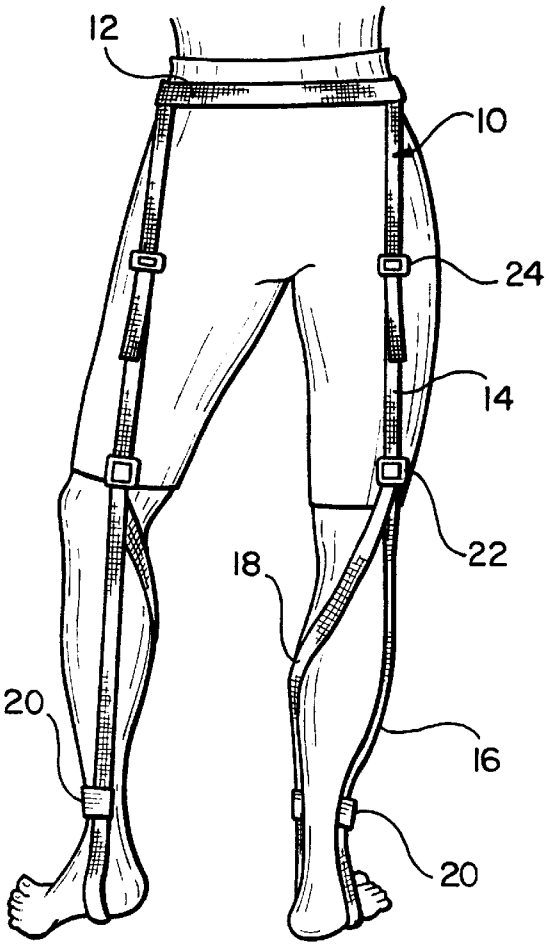
FIG. 1 is a rearview of the lower half of a cyclist's body in perspective and including a device constituting one preferred embodiment of the present invention worn by the cyclist.

Referring to FIGS. 1 through 4, one preferred embodiment of the present invention utilizes an elastic strap for the energy member generally designated 10 in the drawings. Any suitable elastic material may be used to form the strap. In the preferred embodiment of the present invention, the energy member 10 should have a construction so as to be able to generate a tension force of about three to twelve pounds (3 to 12 lbs.) depending on the strength of the cyclist upon extension of the leg during the downstroke. An optimum force of approximately six pounds (6 lbs.) of tension is preferred for average sizes and strengths of cyclists. In the preferred embodiment of the present invention the energy member includes two lower straps or members 16 and 18 and a single upper member 14 as shown in FIG. 1. The upper member 14 is attached to any suitable location on the body such as in the preferred embodiment about the waist by means of a waist member, band or belt 12. The bottom of the energy member in the preferred embodiment is attached to the feet by extending the strap about the bottom of the feet as shown in FIG. 1.

In the preferred embodiment a single elastic strap 10 may be employed with the upper end of the strap passing about the waist band 12 and extending downwardly through an adjustment buckle 22, about the outside of the calf of the leg at 16, about the bottom of the foot and then about the inside of the calf at 18 and terminating in an end passing through the buckle 22. Lower energy members 16 and 18 may be adjusted through the buckle 22 while the upper energy member 14 may be adjusted through buckle 24 so that the length of the energy members may be adjusted to suit the particular length of the cyclist's legs.

In the preferred embodiment, an ankle band shown at 20 is provided to interconnect the lower energy members 16 and 18 to help secure and balance them in place on the opposite sides of the cyclist's calf. Ankle band 20 may be made from any suitable material which is attached by sewing or otherwise to lower portions of the energy members 16 and 18 as shown in the drawings.

Figure 4:
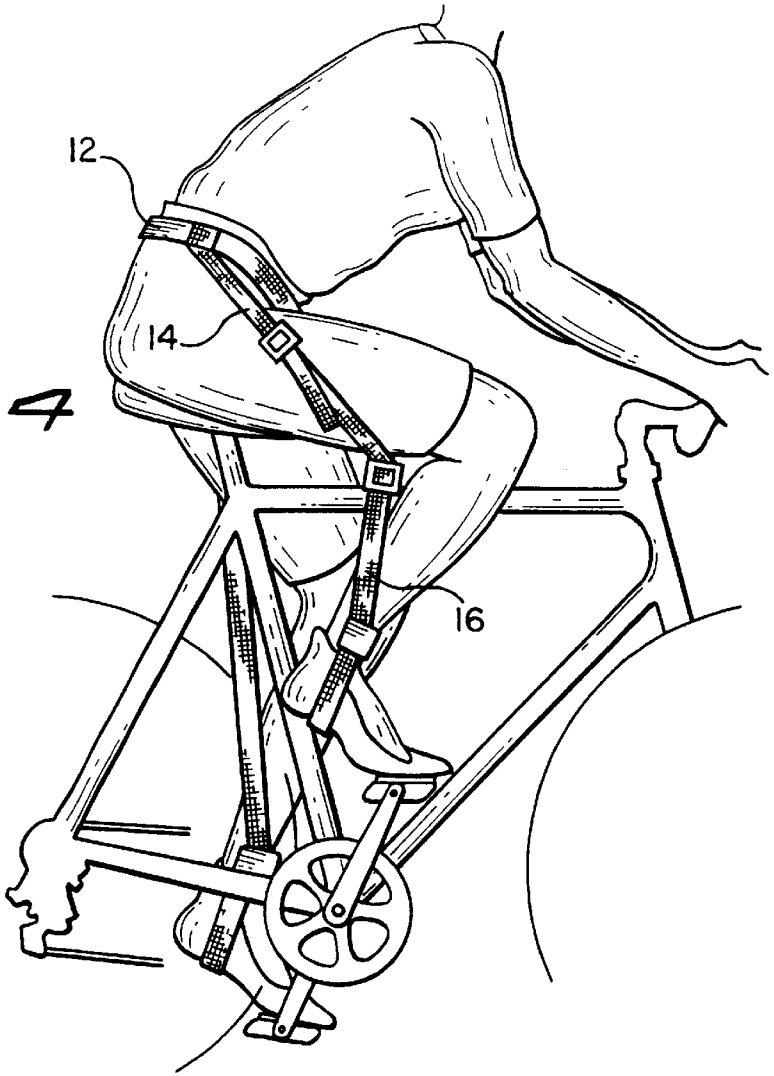
FIG. 4 is a view generally similar to FIG. 3 except showing the opposite side of FIG. 3.
Figure 5:
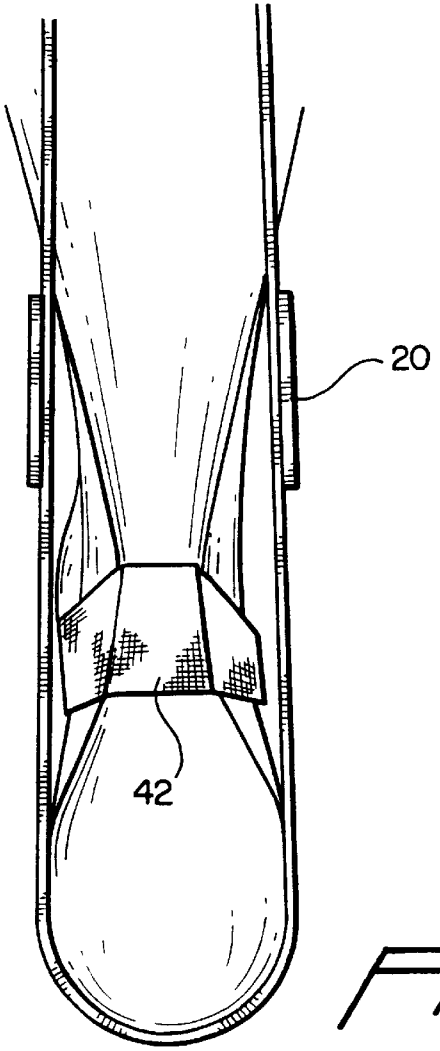
FIG. 5 is a rear view of the foot-ankle area of the cyclist.

In use of the energy members 10 of the present invention it is preferred that each of the legs be provided with them as shown in FIG. 4. During the downstroke of each leg such as shown for example by the left leg in FIG. 3, the energy members 16 and 18 will stretch and store energy in the range of 3 to 12 pounds and preferably 6 pounds whereupon during the upstroke of the leg shown in FIG. 4 the energy will be transferred to the legs for helping the hamstring and other muscles during the upstroke. Not only do the energy members provide extra energy and force on the upstroke of the pedals but they also help to bring the quadriceps and hamstring muscles closer into balance in cases where the quadriceps muscles are abnormally stronger than the hamstring muscles in a particular cyclist. The energy members are particularly useful for cyclists whose hamstring muscles have abnormally less strength than the quadriceps muscles bringing the two out of balance. The overall result of the energy members of the present invention is that the cyclist is able to increase the efficiency and speed of pedaling to increase the speed of the sprocket and in turn the bicycle.

Figure 7:
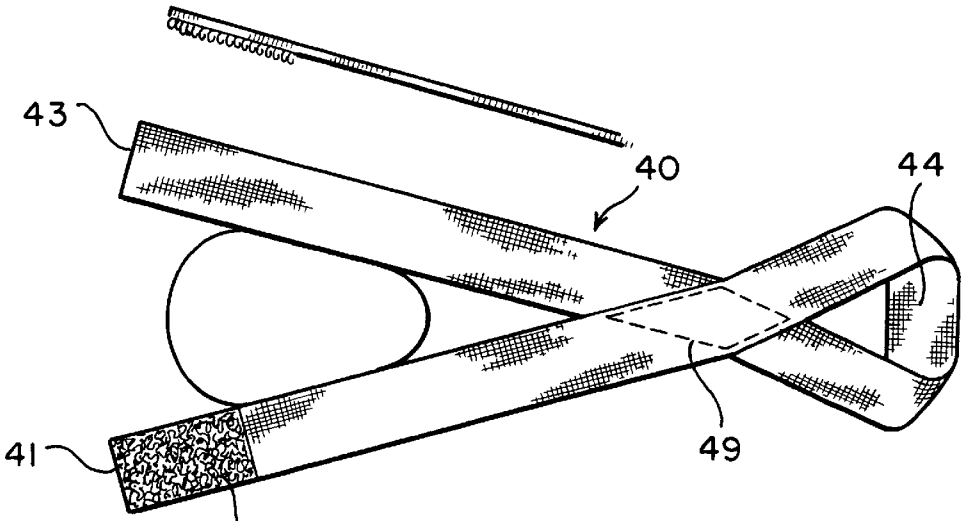
FIG. 7 is a plan view of a foot-ankle member to be worn by the cyclist as shown in FIGS. 5, 6 and 8.

In the preferred embodiment of the present invention, additional transfer of energy to the legs and feet for rotating the sprocket with greater speed and efficiency is achieved through the use of energy members worn on the feet. In the preferred embodiment shown in FIGS. 5 through 8, the energy member takes the form of an elastic strap generally designated 40 best shown in FIG. 7.

The foot member 40 has a forward end generally designated 44 defining a loop for receiving the front of the cyclist's foot. The opposite end of the foot member 40 has two free ends 41 and 43 adapted to be fastened together about the rear of the ankle area of the cyclist to mount the foot member 40 on the foot-ankle area. Any suitable fastener may be employed such as VELCRO material 46 for fastening the ends 41 and 43 about the rear of the foot as best shown at 42 in FIGS. 5 and 6.

Figure 8:
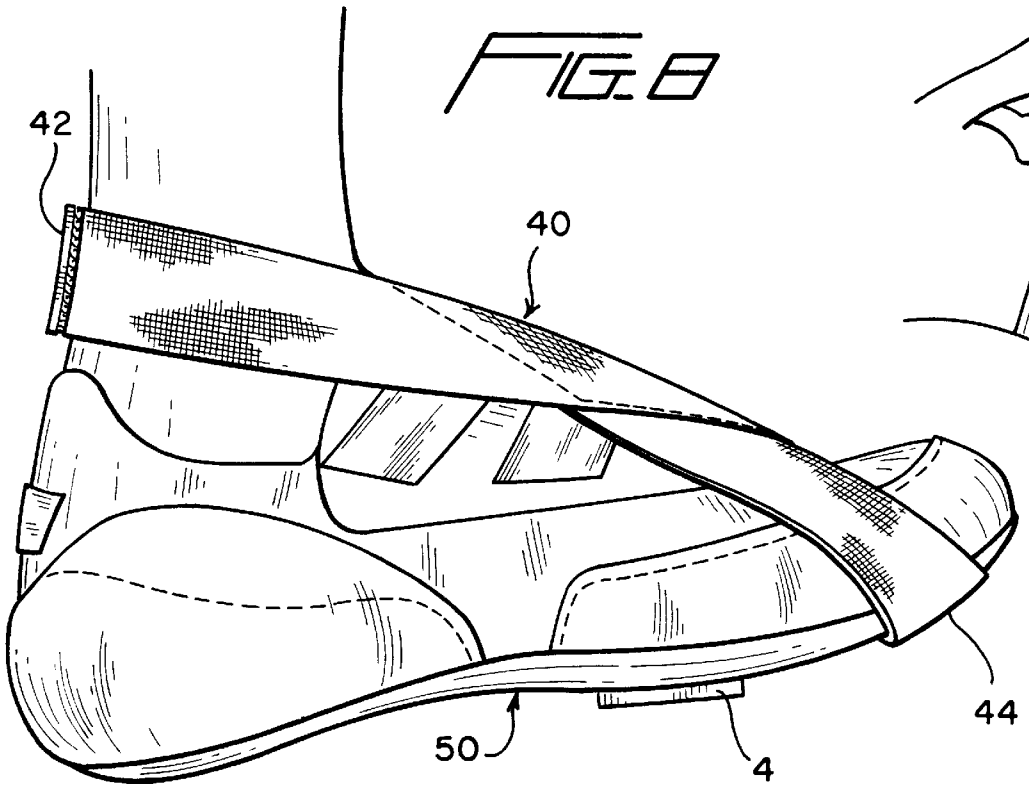
FIG. 8 is a side elevational view of the foot-ankle area of the cyclist shown with the cyclist's shoe and a foot-ankle member extending around the front of the shoe and around the ankle area of the cyclist.

Referring now to FIG. 8, it illustrates that the foot member 40 in addition to being mounted with its front loop around the foot or the toes of the cyclist, may also be mounted around the front end of the cyclist's shoe generally designated 50 in FIG. 8. In the preferred embodiment, the energy member 40 for the foot-ankle area may be made from any suitable elastic, plastic or cloth or other fabric that is of course stretchable to generate and release energy. In the specific embodiment shown if FIG. 7, the energy member 40 is constructed by two intersecting strap areas at the forward end which are sewn or otherwise fastened together at the area 49 shown in FIG. 7. The energy member 40 may of course be made in any other suitable manner. In the preferred embodiment the energy member is made of material and dimensions that when the cyclist points his foot downwardly during pedaling the energy member 40 will be stretched to a degree generating a tension force of approximately 2 to 4 pounds which will be transferred to the foot when the foot returns to the horizontal or generally upward position during cycling. This achieves smoother and faster rotation of the pedals and in turn the crank and sprocket resulting in greater cycle speed for a specific cyclist.

Figure 10:
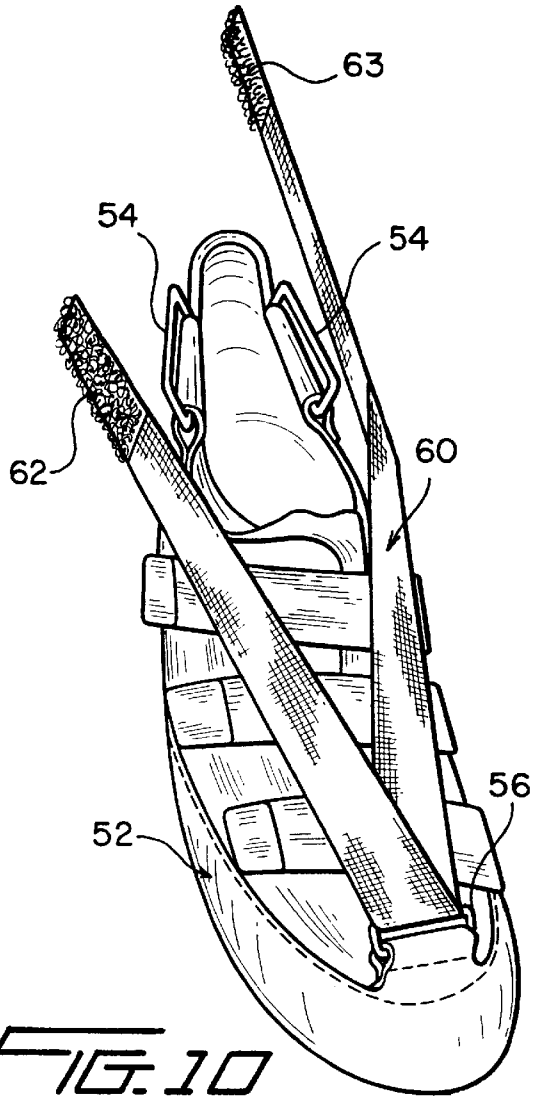
FIG. 10 is a front perspective view of a cyclist's shoe shown in FIG. 9.
Figure 2:
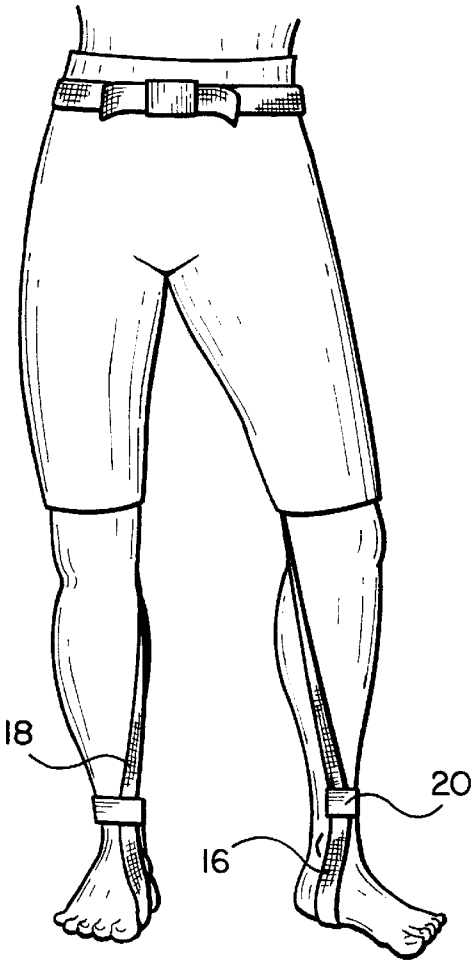
FIG. 2 is a front perspective view of the cyclist's body shown in FIG. 1.
Figure 9:
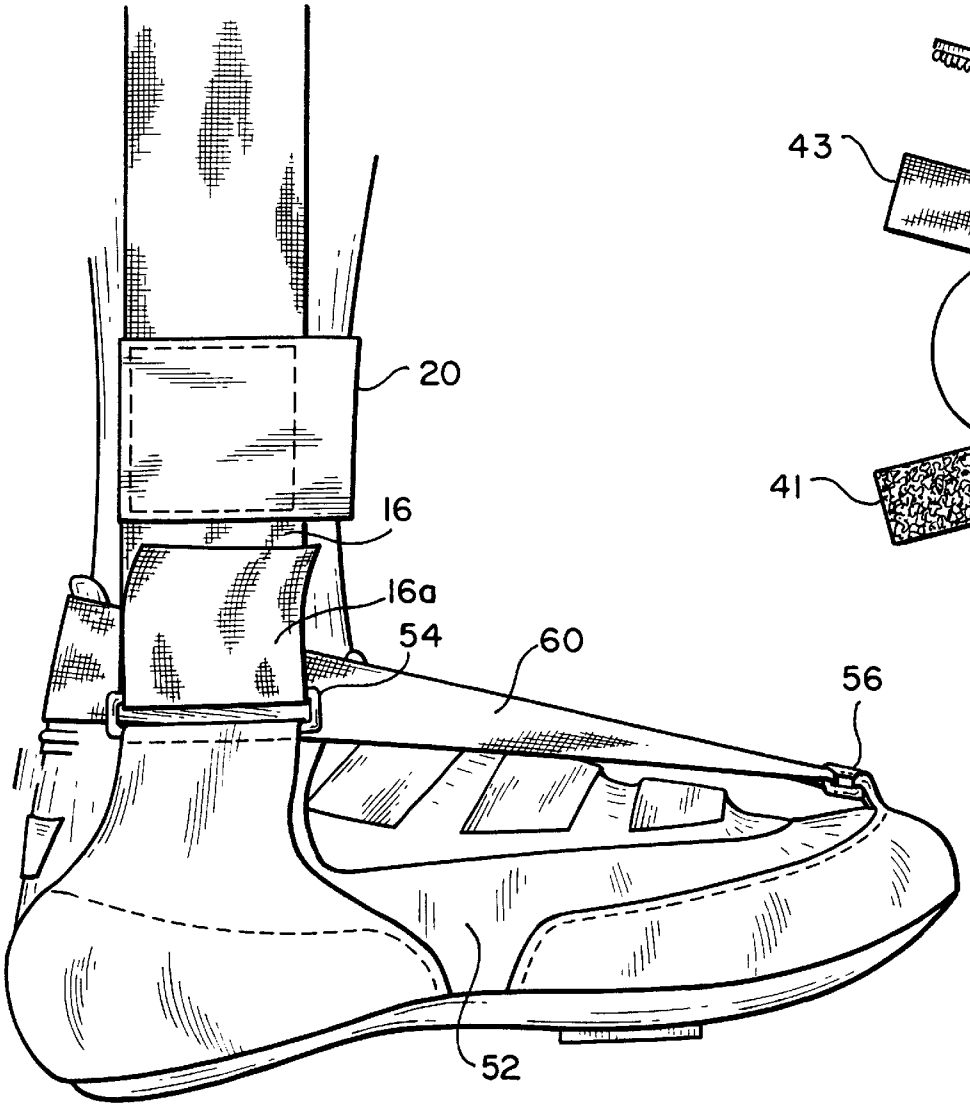
FIG. 9 is a side elevational view of the foot-ankle area of the cyclist but illustrating a modification of the present invention.

Referring now to FIGS. 9 and 10, there is shown another embodiment of the ankle-foot energy member of the present invention which instead of utilizing a loop at the front end utilizes a buckle 56 on the front of the cyclist's shoe 52 for receiving the energy member 60 as best shown in FIGS. 9 and 10. The rear ends 62 and 63 of the foot member are also provided with hook-pile materials such as Velcro for attaching the rear members 62 and 63 to each other about the upper rear end of the cyclist's shoe 52 as best shown in FIG. 9. In the present embodiment the energy members extending along the calf or calves do not extend about the bottom of the cyclist's foot but rather are passed through buckles 54 suitably mounted on opposite sides of the cyclist's shoe 52 as best shown in FIGS. 9 and 10 for receiving and securing the end portions of the energy members such as shown at 16*a* in FIG. 9. If desired the end portion 16*a* may be further fastened again through Velcro material on the main body of the energy member 16.

The energy members 14, 16 and 18 of the present invention may be worn with or without an outer garment or tights.

Figure 11:
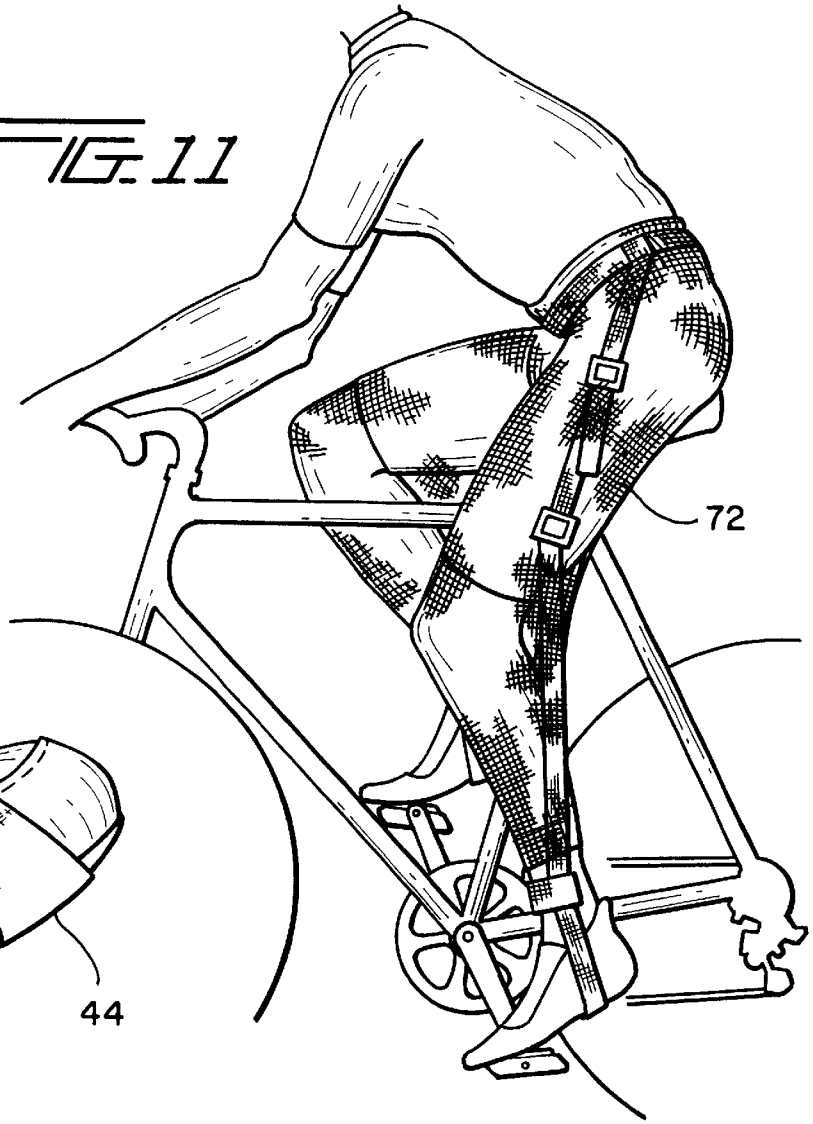
FIG. 11 is a side elevational view of a cyclist on a bicycle wearing the device of the present invention and leg tights overlying the device.

FIG. 11 shows them worn with an outer net like garment in the form of bikers pants or tights 72. In addition and although not shown, the energy members 14, 16, and 18 of the present invention may be incorporated as an integral part of a cyclist's tights or pants to provide the same tension force upon the downstroke to aid the legs upon the upstroke as described above. The tights may be made from LYCRA or any other suitable material including stretchable material to provide energy members in accordance with the present invention.

It will be seen from the above that the present invention will not only create additional force to be transferred directly to the legs to assist the legs in pedaling the bike but it will also provide additional force available to the hamstrings muscles to bring them to balance or closer to balance with respect to the quadriceps muscles in cases where these muscles are out of balance in a given cyclist. The result is that a given cyclist using the energy members of the present invention will be able to increase the speed of a given cycle.

Although in the specific and preferred embodiments described above and shown in the drawings, the energy members are shown in the form of straps, the energy members may take other constructions, dimensions and shapes, and even springs or spring material may be used and also incorporated into a garment to be worn on the legs of the cyclist. Therefore the present invention will cover various modifications readily apparent to those skilled in this art, it being understood that the scope of the present invention is indicated in the appended claims.

I claim:

1. A device for assisting a cyclist to drive a cycle having a crank and pedals connected to the crank, the device comprising in combination, at least one elastic leg member and means for attaching the elastic leg member to a cyclist above and below the knee such that upon extension of the leg to push one pedal down on a downstroke of the pedals said leg member will stretch and store energy for assisting hamstring muscles in the leg to raise the leg to pull the pedal upwardly during an upstroke of the pedals.

2. The device defined in claim 1 wherein said elastic leg member is constructed such that it will generate a tension force in the range of about 3 to 12 pounds upon extension of the leg during the downstroke.

3. The device defined in claim 2 wherein said elastic leg member is constructed such that it will generate a tension force of about 6 pounds upon extension of the legs during the downstroke.

4. The device defined in claim 1 including a pair of said elastic leg members arranged to be attached to the leg of a cyclist above and below the knee.

5. The device defined in claim 4 including a hip member mountable about the hips of a cyclist, said leg members being connected to the hip member.

6. The device defined in claim 4 wherein said elastic members are arranged to extend generally on opposite sides of the calve of the leg.

7. The device defined in claim 6 wherein there is further included means on said calve members for attaching the calve members to the leg at the ankle-foot area of the leg.

8. The device defined in claim 4 wherein the elastic members are adapted to extend about the bottom of the foot and wherein there is further included an ankle member for extending generally about the ankle area to secure the calve members in position generally on opposite sides of the calve members.

9. The device defined in claim 4 including two pairs of said elastic leg members respectively to be worn on opposite sides of the calves of the legs.

10. The device defined in claim 1 including two of said leg members for attachment to the legs respectively.

11. The device defined in claim 1 wherein said leg member includes an elastic strap and means for adjusting the length of the strap.

12. Articles to be worn by a cyclist during operation of a cycle such as a bicycle including in combination, an elastic calve member to be attached at two spaced locations along the leg so as to extend along the calve of the leg, said calve member being constructed to stretch when the cyclist pushes a pedal of the cycle down to rotate an associated sprocket during a downstroke of the pedal and to contract during the upstroke of the pedal and transfer energy assisting the legs to rotate the sprocket through the pedals, and an elastic ankle-foot member adapted to be worn on the foot and extend between the ankle and a forward location on the foot such that said ankle-foot member will stretch on the down-stroke of the pedal and contract on the upstroke of the pedal to generate and release energy for assisting rotation of the pedals and in turn the sprocket.

13. A device for assisting a cyclist to drive a cycle having a crank and a pedals connected to the crank, the device comprising in combination, at least one elastic leg member and means for attaching the elastic leg member to the leg of a cyclist such that upon extension of the leg to push one pedal down on a down-stroke of the pedal said leg member will stretch and store energy for assisting hamstring muscles in the leg to raise the leg to pull the pedal upwardly during an upstroke of the pedal, said elastic leg member being constructed such that it will generate a tension force in the range of about 3 to 12 pounds upon extension of the leg during the down-stroke.

* * * * *